US009131759B2

(12) United States Patent
Seminara

(10) Patent No.: US 9,131,759 B2
(45) Date of Patent: Sep. 15, 2015

(54) METHOD FOR DYEING/BLEACHING HAIR AND RELATIVE APPLICATOR TOOL

(76) Inventor: Angelo Seminara, London (GB)

( * ) Notice: Subject to any disclaimer, the term of this patent is extended or adjusted under 35 U.S.C. 154(b) by 0 days.

(21) Appl. No.: 14/241,684

(22) PCT Filed: Aug. 29, 2012

(86) PCT No.: PCT/IT2012/000261
§ 371 (c)(1),
(2), (4) Date: Feb. 27, 2014

(87) PCT Pub. No.: WO2013/030856
PCT Pub. Date: Mar. 7, 2013

(65) Prior Publication Data

US 2014/0224272 A1 Aug. 14, 2014

(30) Foreign Application Priority Data

Sep. 1, 2011 (IT) ..... RN2011A0062

(51) Int. Cl.
*A45D 7/04* (2006.01)
*A45D 19/00* (2006.01)
*A45D 7/00* (2006.01)

(52) U.S. Cl.
CPC ..... *A45D 7/04* (2013.01); *A45D 19/0016* (2013.01); *A45D 19/0025* (2013.01); *A45D 2007/001* (2013.01)

(58) Field of Classification Search
CPC ... A45D 19/0016; A45D 19/0025; A45D 7/04
USPC ..... 132/202, 208, 209, 211, 270
See application file for complete search history.

(56) References Cited

U.S. PATENT DOCUMENTS

| | | | | |
|---|---|---|---|---|
| 4,196,741 | A | 4/1980 | Minghenelli | |
| 5,058,609 | A | 10/1991 | Sandoz et al. | |
| 5,287,864 | A | 2/1994 | Gallo | |
| 5,335,679 | A | 8/1994 | Baxter | |
| 5,664,590 | A | 9/1997 | Plateroti et al. | |
| 5,799,669 | A * | 9/1998 | Briggs | 132/208 |
| 2009/0139538 | A1 * | 6/2009 | Cheung | 132/270 |

(Continued)

FOREIGN PATENT DOCUMENTS

| | | |
|---|---|---|
| CA | 2229606 | 10/1999 |
| EP | 0122145 | 10/1984 |
| FR | 2947425 | 1/2011 |

(Continued)

OTHER PUBLICATIONS

International Search Report dated Apr. 26, 2013 from counterpart app PCT/IT2012/000261.

(Continued)

*Primary Examiner* — Rachel Steitz
(74) *Attorney, Agent, or Firm* — Timothy J. Klima; Shuttleworth & Ingersoll, PLC

(57) ABSTRACT

A method for dyeing/bleaching hair, includes the steps of applying to the hair at least one strip of adhesive material in a direction which is longitudinal to the hair, in such a way to form and retain by means of adhesion a random lock of hair; lifting the lock of hair to be dyed/bleached so as to isolate it from the rest of the hair; turning over the strip with the lock of hair adhering to it; dyeing/bleaching the lock of hair; protecting the dyed/bleached lock of hair; waiting for the color to develop; and removing the strip.

15 Claims, 2 Drawing Sheets

(56) References Cited

U.S. PATENT DOCUMENTS

| | | | |
|---|---|---|---|
| 2010/0083977 | A1 | 4/2010 | Goddard-Clark et al. |
| 2011/0073129 | A1 | 3/2011 | Russell |

FOREIGN PATENT DOCUMENTS

| | | |
|---|---|---|
| GB | 2432117 | 5/2007 |
| WO | 00/21403 | 4/2000 |
| WO | 02/071891 | 9/2002 |

OTHER PUBLICATIONS

Anonymous: www.discountbannerprinting.co.uk/stickers/clear-stickers.html.

Anonymous: "Quality clear stickers at a great price", Internet—www.discountbannerprinting.co.uk/stickers/clear-stickers.html Aug. 17, 2010 [retrieved from Internet Apr. 12, 2013].

* cited by examiner

METHOD FOR DYEING/BLEACHING HAIR AND RELATIVE APPLICATOR TOOL

This application is the National Phase of International Application PCT/IT2012/000261 filed Aug. 29, 2012 which designated the U.S. and that International Application was published under PCT Article 21(2) in English.

This application claims priority to Italian Patent Application No. RN2011A000062 filed Sep. 1, 2011, which application is incorporated by reference herein.

TECHNICAL FIELD

The present finding relates to a method for dyeing/bleaching hair, and to a relative applicator tool.

BACKGROUND ART

Operative methods are known for dyeing hair, which provide the use of aluminium foil strips, end wraps in various materials, and/or also plastic caps, etc., onto which the hair is laid during dyeing/bleaching, as auxiliary accessories for the hairdresser.

For example, in the case of using aluminium foils, bleaching is obtained by a method which provides a succession of steps substantially consisting of sectioning the hair to be dyed/bleached by means of a tail comb; forming the lock; arranging the lock on the aluminium foil strip; depositing a dyeing fluid or gel onto the lock; protecting the dyed/bleached lock by, for example, superposition of a protective sheet, or by folding the lock on itself, with the lock contained within the fold; waiting for the penetration of the dye into the hair structure; and, finally, washing the hair with removal of the strips and final drying of the dyed/bleached hair.

A completely similar technique provides, as a replacement for the aluminium foil, the use of a transparent plastic material sheet. However, notwithstanding the different nature of the material constituting the strip, the dyeing/bleaching operations proceed in a substantially similar manner to those of the preceding case.

DISCLOSURE OF THE INVENTION

The main drawbacks suffered by all the methods of the prior art come from the fact that, between the lock of hair and the sheet with which the lock is associated, there is a continuous possibility of a relative movement which considerably affects the final result of the treatment during the dyeing/bleaching operations.

In fact, the possibility of a relative movement between the lock and the strip implies that the final dyeing/bleaching, i.e., the aesthetic properties thereof, for example, in terms of tonality, dye uniformity, accuracy of the aesthetic dyeing, depend in a highly relevant manner on the hairdresser's professional skills and his/her creativity of the moment.

Furthermore, the inherent opacity of the aluminium foil, or the equally opaque materials that are used, implies the further drawback of considerably reducing the possibilities of controlling the colour development during the step of waiting for the penetration of the dye into the hair structure.

In fact, since the dye penetration is susceptible of considerably varying as a function of several parameters, such as nature, structure, natural colour of the hair, sex of the subject undergoing the dying treatment, etc., the impossibility of visually checking the progression of the dye penetration leaves some degree of randomness in the final result, which result, again, depends in a highly relevant manner on the hairdresser's professional skills.

Therefore, object of the present finding is to obviate these drawbacks by providing an operative method, which: is easy to use; has a sure aesthetic value; is highly rapid and inexpensive to be carried out; which method can therefore be successfully implemented also by not particularly skilled hairdressers.

BRIEF DESCRIPTION OF THE DRAWINGS

The advantages of the finding will be more clearly apparent from the following detailed description, given with reference to the accompanying drawings, which represent a merely exemplary, non-limiting embodiment thereof, in which.

DETAILED DESCRIPTION OF THE PREFERRED EMBODIMENTS OF THE INVENTION

Figure 1:
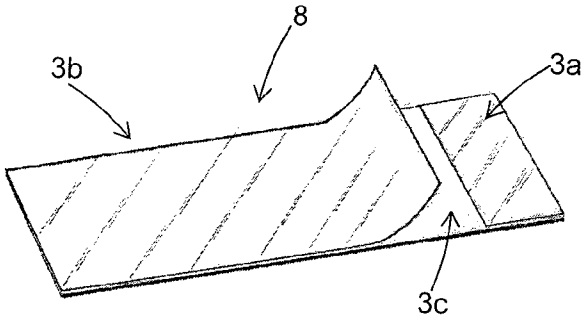
FIG. 1 is a general perspective representation of a particular tool for the implementation of the method.

Referring to FIG. 1 of the appended drawings, a tool for a dyeing bleaching treatment of a lock 2 of hair 1 to be aesthetically treated is wholly indicated by 8, which tool is represented by a multi-layered structure made of sheet materials comprising a first strip 3*a* made of adhesive material, which is removable and in sheet form; a second strip 3*b* made of adhesive material, which is removable and in sheet form; and a third strip 3*c* made of non-adhesive material, also in sheet form.

The first 3*a* and second 3*b* strips are side by side and arranged above the third strip 3*c*.

As regards the material constitution of the strips 3*a*, 3*b*, and 3*c*, the first two strips 3*a* and 3*b* are preferably made of a transparent plastic film, while the third strip 3*c* is made of a card or an equivalent, opaque material.

The plastic film can be produced in multiple different materials, all of which are fungible. The use of a PVC film, having a thickness ranging between about 80-100 microns, was found to be particularly satisfactory. However, this shall not be meant to be limiting, but only as a way of indication example, since other plastic materials having similar characteristics can be used in an equivalent manner.

The plastic film is provided, on a face thereof—the one facing towards the third layer 3*c*—with an adhesive material layer, of a removable type, identified by 7. An acrylic-based emulsion adhesive has proven suitable to a preferred use for the objects of the present finding.

The above-described tool 8 allows implementing a method for subjecting the hair 1 to the dyeing/bleaching treatment, the fundamental bases of which are schematically illustrated in the succession of FIGS. 2 to 7.

Figure 2:
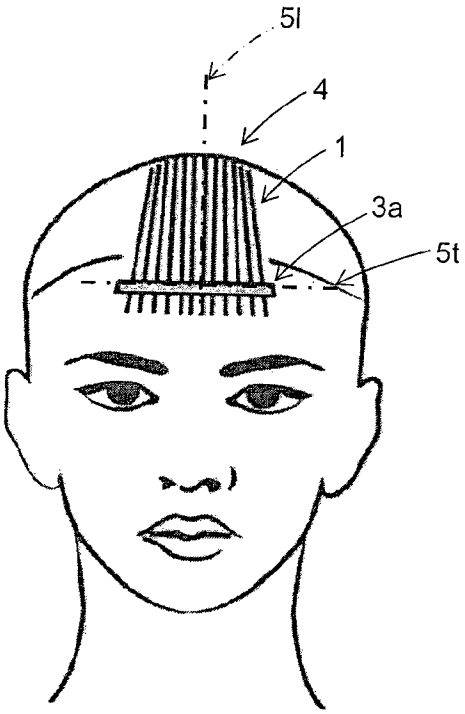
Figure 7:
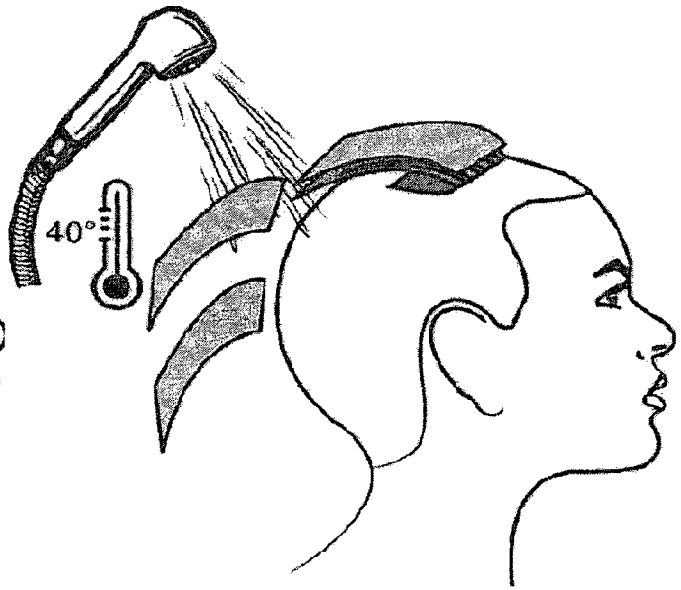

In FIG. 2, an initial step of the method is represented, in which a hairdresser, or the person carrying out the method, provides to select in the hair a section 4 of hair 1 to be subjected to the dyeing/bleaching treatment. Such selection is carried out by associating with the hair 1, in a direction 5*t* which is transversal thereto, a strip 3*a* of a sheet of adhesive material, taken from a sample of the tool 8 of FIG. 1.

Figure 4:
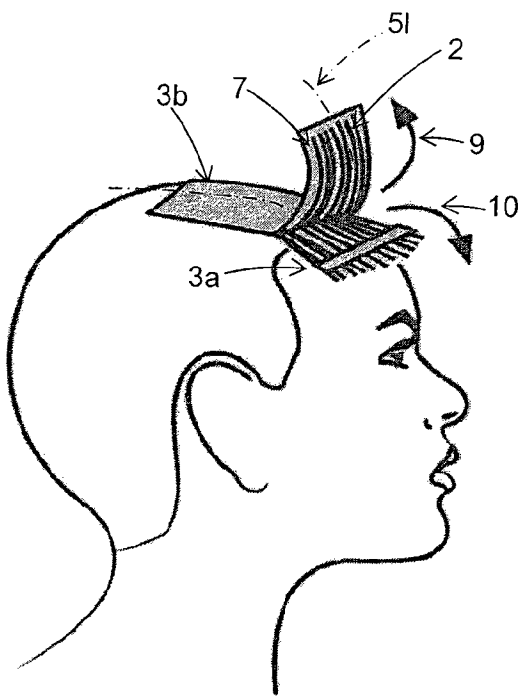
FIGS. 2-7 schematically illustrate the succession of the main steps of the method according to the invention.
Figure 3:
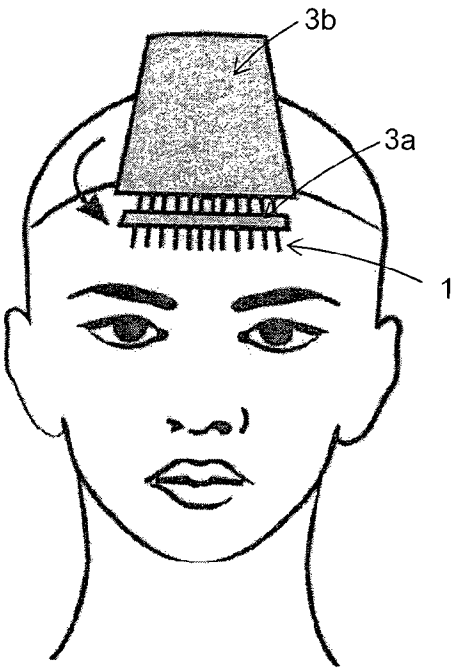

In FIG. 3 and FIG. 4, it is noticed that the hairdresser then provides for the application to the hair 1 of at least one strip 3 *b* of adhesive material in a direction 51 which is longitudinal to the hair 1, and in such a way as to form and retain by means of adhesion a random lock 2 of hair 1.

In order to carry out the application steps of the strips 3*a* and 3*b* to the hair 1, it is sufficient to gently pressing the strips 3*a* and 3*b* against the hair 1 to be dyed/bleached.

More particularly, from the observation of FIG. 4 and from the comparative observation of FIGS. 3 and 4, it is noticed that, in order to form the random lock 2, the hairdresser provides to lift the strip 3*b* with one hand, while holding, with his/her other hand, the remaining portion of the hair belonging to the section 4 (such movements are indicated by the arrows 9 and 10). Due to the effect of such movements, the lock 2 adhering to the strip 3*b* comes to be isolated from the rest of the hair.

Subsequently, the hairdresser provides to turn over the strip 3 with the lock 2 adhering thereto [FIG. 5], then he/she proceeds to dyeing/bleaching the lock 2, which is stationarily retained on the adhesive strip 3*b*, by using the adhesive strip 3*b* itself as a real working top.

In this step, since the hair 1 is stationary, the hairdresser can create all the desired patterns in a highly efficient and rapid manner by, for example, a selectively variable application of the dye in the longitudinal direction 51 of the lock 2.

Figure 6:
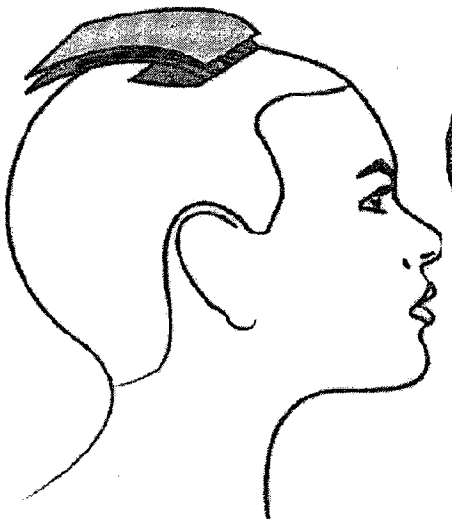

In FIG. 6 it is noticed that, in the further step of the method, the hairdresser provides to protect the dyed/bleached lock 2; to wait for the colour to develop, and, finally (FIG. 7), to remove the strip 3*b* with the aid of a hot water wash.

Figure 5:
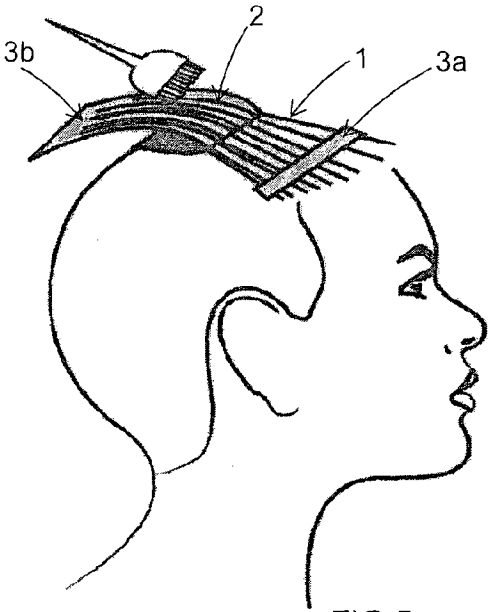

If, as stated above, at least the strip 3*b* which is intended to the longitudinal application to the hair 1, is made of a transparent material, during the steps of FIGS. 5 and 6 it is very easy to control the colour development and the progression of the absorption thereof by the hair 1 structure.

From FIG. 6, it is also possible to notice that the protection step is carried out by superposing to the lock 2 of hair 1 and the adhesive strip 3*b* a further non-adhesive strip 3*c*, arranged longitudinally to the hair 1, and implemented, for example, by the strip 3*c* of opaque material constituting part of the general exemplary tool 8, which is illustrated in FIG. 1.

It is completely apparent that, if a still higher control of the progression of the dye absorption is desired, it is sufficient that also the third strip 3*c* of the tool 8 of FIG. 1 is made of a transparent material. In this way, the step of waiting for the colour to develop can be carried out with a visual check of the lock 2, which is observed in transparency during the development step.

It is apparent that the use of the third layer 3*c* as a protection element for the treated lock 2 represents one of the operative possibilities available to the hairdresser; since it is apparent that, also without using the third strip 3*c*, if the length of the hair 1 and the adhesive strips 3*c* allows that, it is also possible to implement the protection step by simply carrying out a folding and superposition of the strip 3*b* which is applied longitudinally to the lock 2 of hair 1, in order to subsequently have a fully front/back visibility of the lock 2 retained within the fold.

The finding fully achieves the above-described objects, allowing a dyeing method which is completely innovative, which allows selecting, isolating, and dyeing with a high accuracy amounts of hair which are as reduced and random as desired. A number of advantages are also provided by the inherent features of the support 8.

In fact, since the hair 1 are stationarily and firmly retained by the support 8, as well as removably, when appropriate, the dyeing/bleaching treatment can be also carried out by several and selectively variable dye applications along a longitudinal direction 51 of the lock 2.

This feature allows to any not-so skilled hairdresser to be able to advantageously operate by a single, simple, and rapid movement in order to select, isolate the hair 1, and constrain them to the strip 3*b*; and, as advantageously, to be able to create particular decorations of different colour tones along the entire length of the hair 1. That allows obtaining highly accurate decorations and high aesthetic effect results.

Still another advantage, related to the fact that the locks 2 can be positioned with a high accuracy on the strips 3*b*, while being able to maintain the position thereof unaltered during the dyeing treatment, is that it allows establishing metric references, upon positioning the hair 1, which references allow successfully replicating with a high accuracy, by the dyeing treatment, the desired aesthetic patterns also at a later time, from a dyeing treatment to the next one.

In fact, it is possible to achieve both a highly uniform, diffuse colour on the entire hair length, which is otherwise difficult to achieve and replicate without the aid of a tool; or to highlight the colour and its hues in a differentiated manner on the length of the lock 2, in order to reproduce the chromatic variety of the tones, which simulates natural hair 1 colour.

The finding thus conceived is clearly susceptible of industrial application; it can also be the object of numerous modifications and variations, all of which fall within the scope of the inventive concept; furthermore, all the details can be replaced by technically equivalent elements.

The invention claimed is:

1. A method for dyeing/bleaching hair comprising steps of:

applying to the hair at least one strip of adhesive material in a direction which is longitudinal to the hair, in such a way as to form and retain by adhesion a random lock of hair;

lifting the lock of hair to be dyed/bleached to isolate the lock of hair from a rest of the hair;

turning over the at least one strip with the lock of hair adhering to the at least one strip;

dyeing/bleaching the lock of hair;

protecting the dyed/bleached lock of hair;

waiting for the color to develop; and removing the strip.

2. The method according to claim 1, wherein the application step comprises a preliminary step of selecting a section of hair to be subjected to the dyeing/bleaching treatment.

3. The method according to claim 2, wherein the selection step is carried out by associating with the hair, in a direction which is transversal to it, a further strip of a sheet of adhesive material.

4. The method according to claim 1, wherein the application step for one or each strip is carried out by gently pressing the at least one strip against the lock of hair to be dyed/bleached.

5. The method according to claim 1, wherein the dyeing/bleaching step is carried out by variable selective application of dye in the longitudinal direction of the lock of hair.

6. The method according to claim 1, wherein at least the step of longitudinal application of the adhesive strip to the hair is carried out with a strip made of transparent material.

7. The method according to claim 6, wherein the step of waiting for the color to develop is carried out with a visual check of the lock of hair which is observed through the strip made of transparent material.

8. The method according to claim 1, wherein the protection step is carried out by folding and superposing on the lock of hair the at least one strip which was applied longitudinally.

9. The method according to claim 1, wherein the protection step is carried out by superposing on the lock of hair and on the at least one strip a further strip which is not adhesive.

10. The method according to claim 9, wherein the non-adhesive strip is made of opaque material.

11. A tool for dyeing/bleaching a lock of hair, comprising:

a multi-layer structure made of sheet materials comprising:

a first strip made of adhesive material, which is removable and in sheet form;

a second strip made of adhesive material, which is removable and in sheet form, the second strip being separate from the first strip; and a third strip made of non-adhesive material in sheet form;

wherein she first strip and the second strip are positioned side-by-side each other ad attached to one side of the third strip by adhesive material, each of the strips being removable from the multi-layer structure whereby the first strip is removable from the multi-layer structure for being associated with hair of a subject for selecting a section of hair; the second strip is removable from the multi-layer structure for being superposed to the hair in such a way as to isolate and retain by adhesion a random lock of hair from the hair; and the third strip is removable from the multi-layer structure for protecting the lock of hair while waiting for color to develop.

12. The support according to claim 11, wherein at least the second strip is made of transparent material.

13. The support according to claim 12, wherein the transparent material comprises a plastic film.

14. The support according to claim 13, wherein the plastic film is made of PVC of suitable thickness.

15. The support according to claim 14, wherein the adhesive material comprises an acrylic substance in an emulsion.

* * * * *